US010669064B2

(12) United States Patent
Shabani Sofla

(10) Patent No.: US 10,669,064 B2
(45) Date of Patent: Jun. 2, 2020

(54) SEALABLE MULTI-POSITIONAL CAN LID

(71) Applicant: Jafar Shabani Sofla, Esfahan (IR)

(72) Inventor: Jafar Shabani Sofla, Esfahan (IR)

( * ) Notice: Subject to any disclaimer, the term of this patent is extended or adjusted under 35 U.S.C. 154(b) by 198 days.

(21) Appl. No.: 15/979,440

(22) Filed: May 14, 2018

(65) Prior Publication Data

US 2018/0257811 A1 Sep. 13, 2018

(30) Foreign Application Priority Data

May 15, 2017 (IR) ..... 139650140003002055

(51) Int. Cl.
*B65D 17/34* (2006.01)
*B65D 47/26* (2006.01)

(52) U.S. Cl.
CPC ..... *B65D 17/34* (2018.01); *B65D 47/265* (2013.01); *B65D 2101/0023* (2013.01); *B65D 2517/0013* (2013.01); *B65D 2517/0038* (2013.01); *B65D 2517/0049* (2013.01)

(58) Field of Classification Search
CPC .... B65D 2251/0018; B65D 2251/0015; B65D 2251/0012; B65D 2101/0023; B65D 47/265; B65D 17/34
USPC ..... 220/242, 254.9
See application file for complete search history.

(56) References Cited

U.S. PATENT DOCUMENTS

| | | | | |
|---|---|---|---|---|
| 3,289,880 | A | 12/1966 | Wilkich | |
| 3,326,406 | A | 6/1967 | Brown | |
| 3,446,389 | A | 5/1969 | Brown | |
| 4,579,245 | A * | 4/1986 | Narushko | B65D 47/265 220/253 |
| 7,275,653 | B2 | 10/2007 | Tedford, Jr. | |
| 2006/0191933 | A1 | 8/2006 | Hicks et al. | |
| 2008/0041862 | A1 | 2/2008 | Bal | |
| 2010/0102060 | A1 * | 4/2010 | Ruse, Jr. | B65D 43/0204 220/254.9 |
| 2012/0312816 | A1 | 12/2012 | Barreto et al. | |

FOREIGN PATENT DOCUMENTS

GB 2410245 A 12/2003

* cited by examiner

*Primary Examiner* — King M Chu
(74) *Attorney, Agent, or Firm* — NovoTechIP International PLLC

(57) ABSTRACT

An improved multi-positional lid for a beverage can includes an outer layer and an inner layer, one of which is rotatable around a central point, thus providing various changeable modes for the can. One mode enables the user to drink the beverage through an opening designed for a straw, a second mode provides a larger opening designed for direct consumption, and a third mode enables closure of the lid to protect the contents inside. The multi-positional lid can also include a removable tamper resistant sealing layer for keeping the top of the can clean and providing a tamper resistant mechanism.

20 Claims, 15 Drawing Sheets

SEALABLE MULTI-POSITIONAL CAN LID

CROSS REFERENCE TO RELATED APPLICATION

This application claims the benefit of priority to Iran Application Serial Number 139650140003002055, filed on May 15, 2017, the entire content of which is incorporated herein by reference.

TECHNICAL FIELD

The present application relates generally to a beverage can lid, and more particularly to an a sealable, open and closable multi-positional can lid providing various modes of operation.

BACKGROUND

Currently available beverage can lids generally provide a sealed environment inside the can as long the can is kept closed. Once opened, however, the can cannot be resealed or even closed, thus exposing the liquid inside to germs in the environment and increasing the possibility of spilling the liquid. Furthermore, because the can cannot be closed once opened, carbonated drinks are exposed to the environment, causing the drinks to become flat after a short period of time. As a result, the consumer cannot enjoy the drink over an extended period of time. This may result in wasting any amount of the drink in the can that is not consumed within a short period of time after opening the can.

Moreover, to open a can, a tab on the can lid needs to be lifted to create a gap between the lid and the tab. This is sometimes difficult to do. For example, a person having small fingers or long fingernails, may find it hard to lift the tab properly. Furthermore, sometimes that tab breaks before the can is opened, thus rendering the can unusable. In other cases, the tab may break off after the can has been opened, which sometimes leaves sharp edges around the opening through which liquid flows out, thus exposing the consumer to potential injuries.

Therefore, a need exists for providing a can having an improved lid that is open and closable, provides a sanitary option for consuming a drink and easy to open and use.

SUMMARY

A multi-positional lid for a beverage is provided. In one implementation, the multi-positional lid for the beverage can include an outer layer immovably attached to a wall of the beverage can, where the outer layer includes a first large opening and a first small opening, and an inner layer movably connected to the outer layer, where the inner layer includes a second large opening, a second small opening, and a protrusion and an insulated area positioned in a top surface of the inner layer. The protrusion may fit inside the first small opening to movably connect the inner layer to the outer layer, and the inner layer may be rotatable around the protrusion to change a mode of the multi-positional lid by aligning one of the second large opening, the second small opening or the insulated area with the first large opening of the outer layer.

In another implementation, the multi-positional lid for a beverage can include a rotatable outer layer including a first large opening, a small opening, and an insulated area and an indentation on a bottom surface of the rotatable outer layer, and an inner layer permanently attached to a wall of the can, the inner layer including a second large opening, and a protrusion, wherein the protrusion fits inside the indentation to connect the rotatable outer layer to the inner layer, and the rotatable outer layer is rotatable around the protrusion to change a mode of the multi-positional lid by aligning one of the first large opening, the first small opening or the insulated area with the second large opening of the inner layer.

In yet another implementation, multi-positional lid for a beverage can include an outer layer permanently attached to a wall of the can, where the outer layer includes a first large opening, a first small opening. The multi-positional lid for a beverage can also include a rotatable inner layer which may include a third small opening, and a first protrusion, a second protrusion, and an insulated area on a top surface of the rotatable inner layer, and a tab positioned on top of the outer layer and movably connected to the outer layer and the rotatable inner layer, where the tab has an indentation on a bottom surface. The first protrusion may fit inside the first small opening, while the second protrusion passes through the second opening and fits inside the indentation. The rotatable inner layer may also be rotatable around the second protrusion to change a mode of the multi-positional lid by aligning the first large opening with the third small opening or the insulated area or leaving the first large opening unobstructed.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Most currently used can lids consist of two types. One is a completely sealed lid which can be removed by a can opener, and once removed cannot be resealed. This type of lid is normally used for cans that contain edible contents. A second type of can lid is one which includes a tab that can be lifted to create a partial opening in the lid through which the contents of the can may flow out. This type of lid is normally used for beverages to allow a consumer to drink the beverage through the partial opening. Neither one of these designs provides a resealable lid that can be closed to keep the remaining content of the can safe and sanitary. Moreover, both of these lids are hard to open and require effort on the part of the consumer.

A solution is proposed here to solve these issues and more by providing an improved multi-positional lid that is easy to open and close and provides openings through which a user can consume the contents in multiple ways. The multi-positional lid includes two layers which provide three changeable modes. One mode enables the user to drink the beverage either through an opening designed for a straw. Another mode allows the consumer to drink the beverage through an opening designed for direct consumption. A third mode is for closing the lid to protect the contents inside. The multi-positional lid also provides a removable tamper resistant sealing layer for keeping the top of the can clean and sealing the beverage.

Figure 1A:
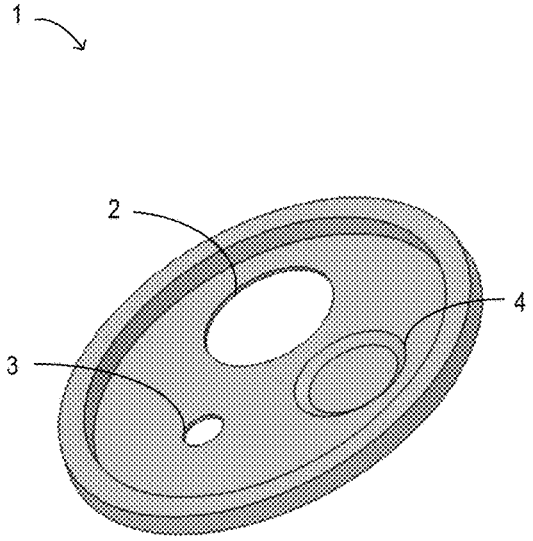
FIGS. 1A-1B are back and front views, respectively, of an inner layer of a multi-positional lid.
Figure 1B:
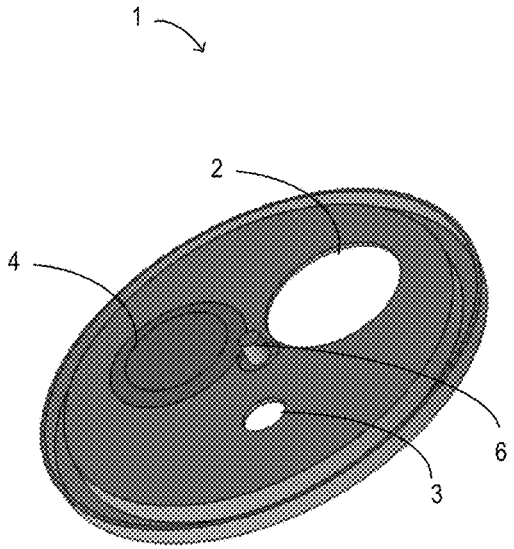

In one implementation, the multi-positional lid includes two layers, a fixed-position outer layer which is directly connected to the wall of the can, and a rotatable inner layer which can be rotated around an axis to provide multiple modes for the can. FIGS. 1A-1B depict back and front views, respectively, of an inner layer 1 of a multi-positional lid, in one implementation. The inner layer 1 includes a small opening 3, a large opening 2 and an insulated area 4. The small opening 3 provides a space through which a straw can be inserted into the can to enable comfortable consumption of the beverage with a straw. The large circular opening 2, on the other hand, can be used for direct consumption of the beverage from the can, as the larger opening allows for easier flowing out of the liquid from the can. The insulated area 4 includes a circular area covered with an insulated material for sealing an opening of the outer layer of the multi-positional lid, as discussed further below. As shown in FIG. 1B, the top surface of the inner layer 1 also includes a protrusion 6 for creating a central point around which the inner layer can rotate.

Figure 1C:
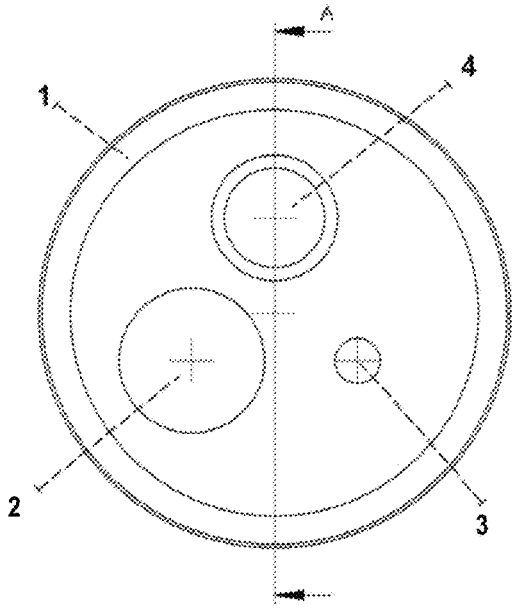
FIGS. 1C-1D are schematic drawings of back and front, respectively, of an inner layer of a multi-positional lid.
Figure 1D:
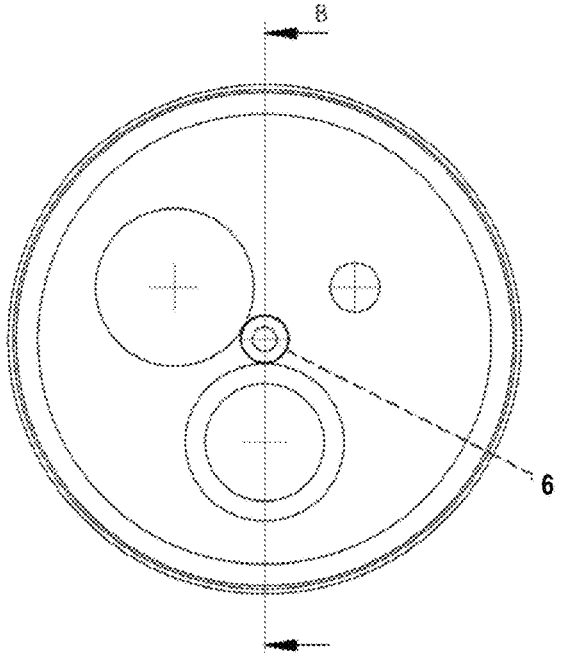

FIGS. 1C-1D are schematics of the back and front surfaces, respectively, of the inner layer 1. The axis A illustrates the axis around which the top surface of the inner layer 1 rotates, and the axis B illustrates the axis around which the bottom surface of the inner layer 1 rotates. As can be seen axes A and B pass through the center of the inner layer 1 at which the protrusion 6 is locate.

Figure 2A:
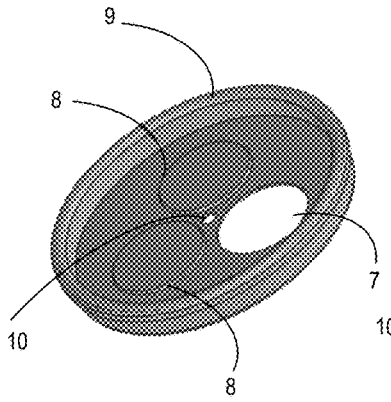
FIGS. 2A-2C are back and front views, and a schematic drawing, respectively, of an outer layer of the multi-positional lid.
Figure 2B:
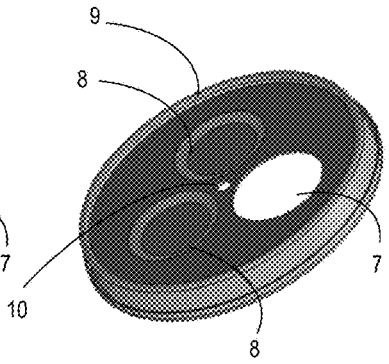
Figure 2C:
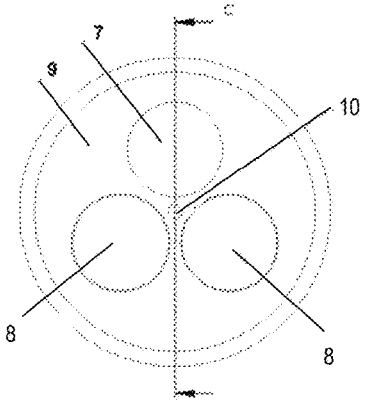

FIGS. 2A-2C depict front and back views, and a schematic, respectively, of an outer layer 9 of the multi-positional lid, in one implementation. The outer layer 9 includes a large opening 7, two housing units 8, and a small opening 10. The large opening 7 may be comparable in size to the large opening 2 and when aligned with the large opening 2 (as a result of rotation of the inner layer 1), can provide a passageway through which the beverage can flow out. The opening 7 can also provide access to the small opening 3 for utilizing a straw when the inner layer 1 rotates to align the small opening 3 with the large opening 7. Once the consumer is done with the beverage and decides to close the lid, the inner layer 1 can be rotated to align the insulated area 4 with the opening 7. The shape of the insulated area 4 is designed such that the insulated materials fits tightly against the opening 7 creating a seal around the perimeter of the opening 7 and thus completely sealing the can. The insulated material covering the insulated area may be silicon or any other material that can act as a sealant while being chemically safe to interact with food. To achieve insulation, the size of the insulated area may be approximately equal to the size of the opening 7. The housing units 8 provide a space into which the insulated area 4 can fit when the inner layer 1 is rotated to open the can. The small opening 10 provides a space through which the protrusion 6 of the inner layer 1 can pass, thus enabling the inner layer 1 to fit tightly against the outer layer while providing an axis C around which the inner layer 1 can rotate.

Figure 3:
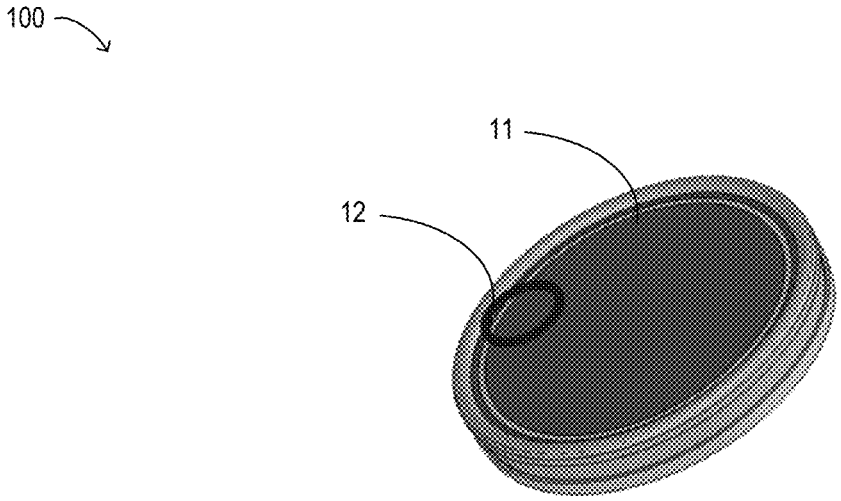
FIG. 3 is a top view of a multi-positional lid having a sealing layer.

In addition to the inner and outer layers, the multi-positional lid 100 may include a removable sealing layer 11, as shown in FIG. 3. The removable sealing layer 11 may be a tamper resistant layer provided for ensuring safety and sanity. Once removed or tampered with, the removable sealing layer 11 cannot be replaced. To remove the sealing layer 11, a handle 12 attached to the sealing layer is positioned on top of the sealing layer 11. In one implementation, the handle 12 is made from a plastic material and is circular in shape. The handle 12 can be lifted up and easily pulled toward the center of the lid to remove the sealing layer 11.

Figure 4A:
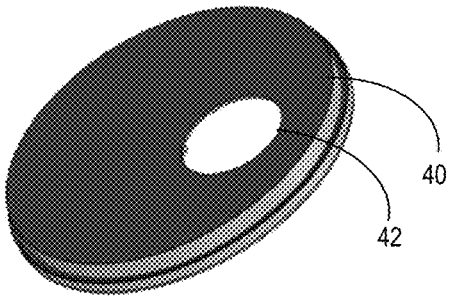
FIGS. 4A-C are front and back views, and a schematic drawing, respectively, of an inner layer of a multi-positional lid, in another implementation.
Figure 4B:
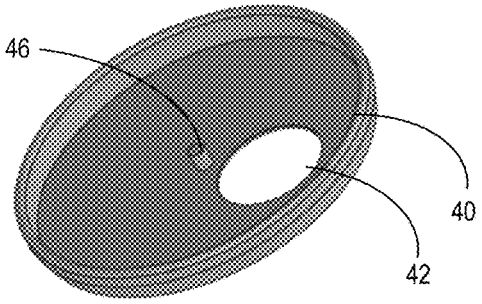
Figure 4C:
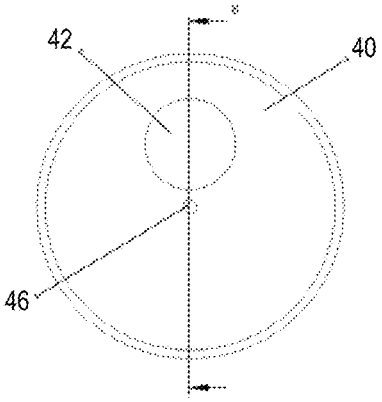

In an alternative implementation of the multi-positional lid, the lid includes two layers, where the outer layer is rotatable around an axis and the inner layer is stationary and attached to the wall of the can. FIGS. 4A-C depict front and back views, and a schematic, respectively, of an inner layer 40 of the multi-positional lid, in such an implementation. The inner layer 40 includes an opening 42, and a protrusion 46 for creating a central point around which the outer layer can rotate. The opening 42 may be comparable in size to an opening of the outer layer of the lid, such that when aligned together (as a result of the rotation of the outer layer), the opening 42 can provide a passageway through which the beverage can flow out. As shown in FIG. 4C, the outer layer can rotate around the axis B.

Figure 5A:
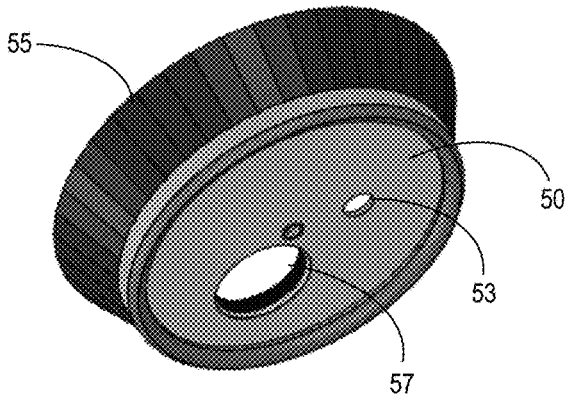
FIGS. 5A-5B are front and back views, respectively, of an outer layer of the multi-positional lid, in another implementation.
Figure 5B:
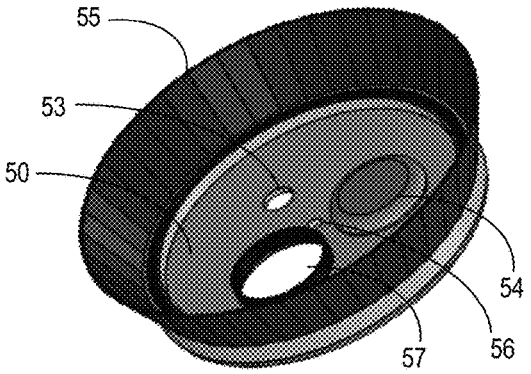

FIGS. 5A-5B depict front and back views, respectively, of an outer layer 50 of the multi-positional lid, in the implementation where the outer layer is rotatable. The outer layer 50 includes a large opening 57, an indentation 56 on the back, an insulated area 54 on the back, and a small opening 53. The large opening 57 may be comparable in size to the opening 42 and when aligned with the opening 42 (as a result of rotation of the outer layer 50), can provide a passageway through which the beverage can flow out. The small opening 53 provides a space through which a straw can be inserted into the can to enable comfortable consumption of the beverage with a straw. To provide access to the beverage, the small opening 53 would need to be aligned with the opening 42 of the inner layer (via rotation of the outer layer 50) to allow the straw to pass through both the inner and outer layers and into the can. Once the consumer is done with the beverage and decides to close the lid, the outer layer can be rotated to align the insulated area 54 with the opening 42 of the inner layer. The shape of the insulated area 54 is designed such that the insulated materials fits tightly against the opening 42 creating a seal around the perimeter of the opening and thus completely sealing the can. To achieve this, the size of the insulated area 54 may be approximately equal to the size of the opening 42.

The indentation 56 provides a space through which the protrusion 46 of the inner layer 40 can fit, thus enabling the inner layer 46 to fit tightly against the outer layer 50 while providing a central point around which the outer layer can rotate. In one implementation, the outer layer 50 also includes a raised edge 55 that helps the lid sit on top of the can. The raised edge 55 may be cone-shaped and circular to provide a good fit against the top of the can. The raised edge 55 can help control the movement of the outer layer 50 and prevent it from being separated from the can.

Figure 6:
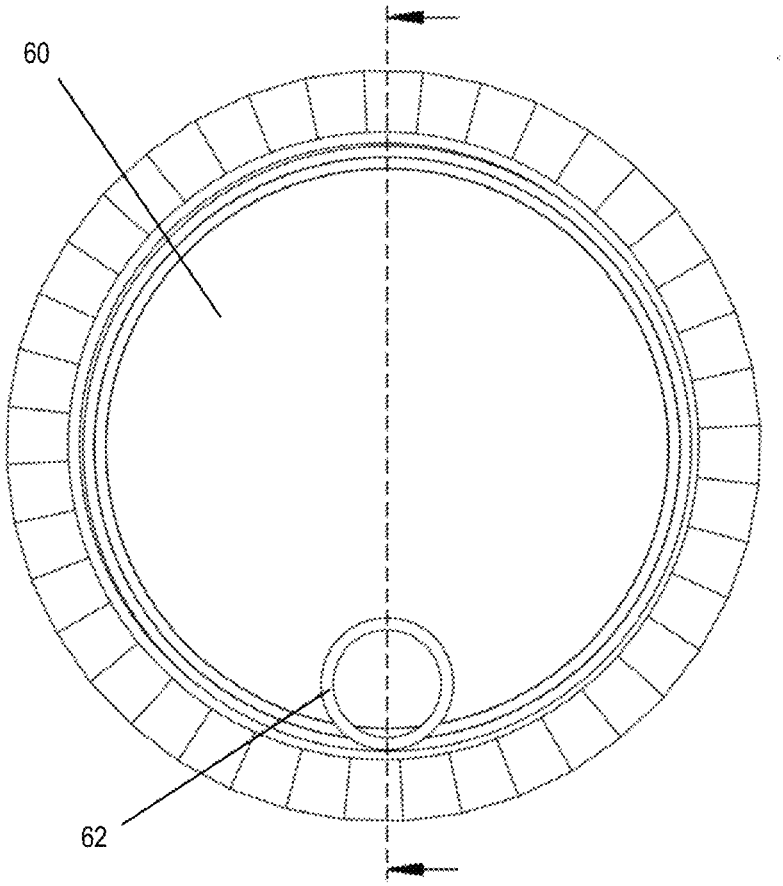
FIG. 6 is a schematic drawing of a top view of the multi-positional lid having a sealing layer.

In addition to the inner and outer layers 40 and 50, the multi-positional lid may also include a removable sealing layer 60, as shown in FIG. 6, which depicts a schematic drawing of the top view of the multi-positional lid. This removable sealing layer 60 may be similar in shape and function to the sealing layer 11 of FIG. 3. To remove the sealing layer 60, a handle 62 may be positioned on the top surface of the sealing layer 60. In one implementation, the handle 62 is made from a plastic material and is circular in shape. The handle 62 can be lifted up and pulled toward the center of the lid to remove the sealing layer 60.

Figure 7A:
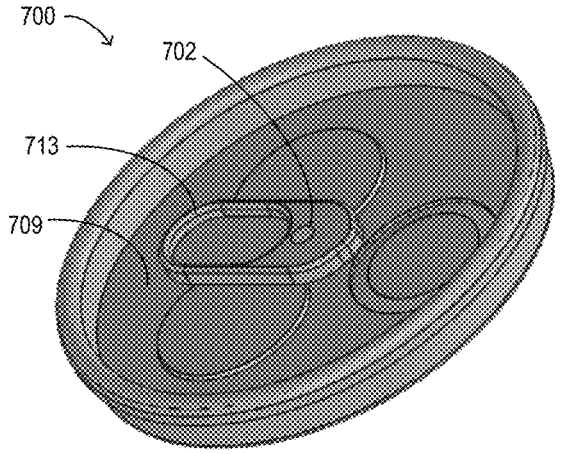
FIGS. 7A-7B are front and back views, respectively, of a multi-positional lid, in yet another implementation.
Figure 7B:
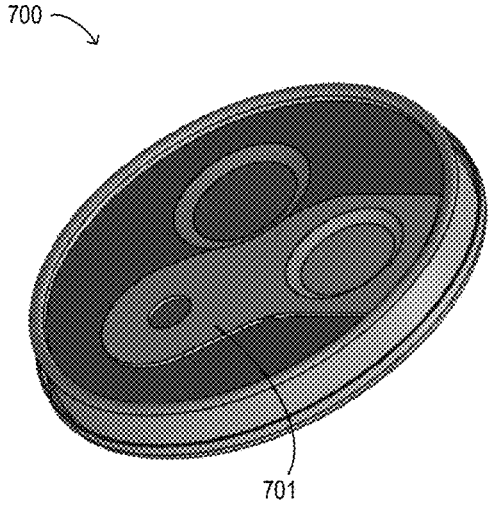
Figure 7C:
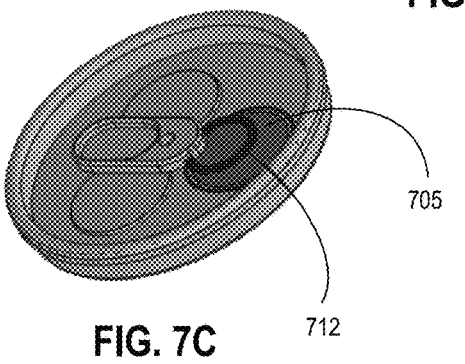
FIG. 7C is a top view of the multi-positional lid of FIGS. 7A-7B, having a sealing layer.

In another alternative implementation of the multi-positional lid, the lid includes two layers, where the outer layer is stationary, the inner layer is rotatable around a central point, and both layers are attached to a tab positioned on the top surface of the outer layer for rotating the inner layer. This is illustrated in FIGS. 7A-7B, which depict front and back views, respectively, of a multi-positional lid 700, in such an implementation. The multi-positional lid 700 includes an outer layer 709, a movable tab 713, and a rotatable inner layer 701, positioned behind the outer layer 709. As shown in FIG. 7C, the multi-positional lid 700 may also include a sealing cover 705 which provides a tamper resistant safety and sanitary seal for the lid 700. The sealing cover 705 can be removed by lifting and/or pulling the handle 712. In one implementation, the handle 712 is made from a plastic material and is circular in shape. Once removed, the sealing cover 705 cannot be replaced, thus providing assurance to the consumer that their can has not been opened or tampered with prior to the consumer removing the seal.

Figure 8:
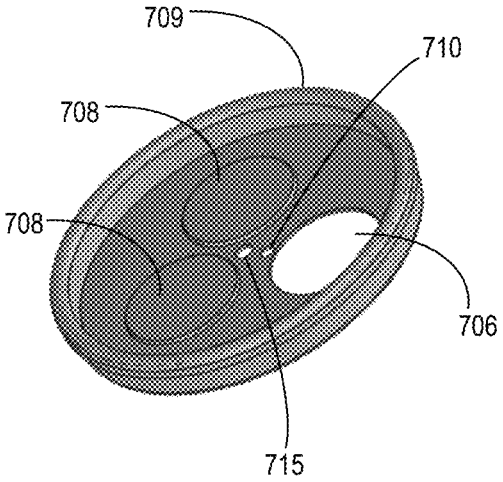
FIG. 8 is a top view of an outer layer of the multi-positional lid of FIGS. 7A-7B.

FIG. 8 depicts the outer layer 709 of the multi-positional lid 700. The outer layer 709 includes a large opening 706, two housing units 708, and two small openings 710 and 715. The large opening 706 provides a passageway through which the beverage can flow out when unobstructed. The housing units 708 provide indentations in the back of the outer layer 709 into which a protruded area of the inner layer can comfortably fit. The two small openings 710 and 715 provide openings into which protrusions of the inner layer can be inserted, as discussed below.

Figure 9A:
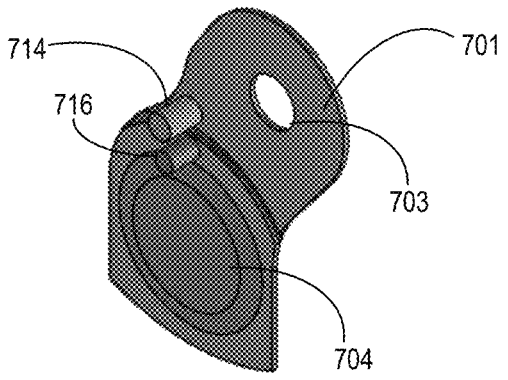
FIGS. 9A-9B are front and back view, respectively, of an inner layer of the multi-positional lid of FIGS. 7A-7B.
Figure 9B:
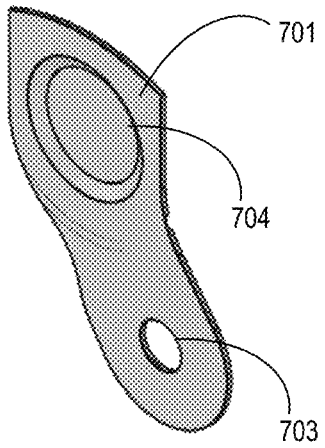

FIGS. 9A-9B depict front and back views of the inner layer 701 of the multi-positional lid 700. The inner layer 701 includes an opening 703, an insulated area 704, and two protrusions 714 and 716. The insulated area 704 is designed such that it can fit tightly into the opening 708 of the outer layer, when needed. Once positioned inside the opening 708, the insulated area 704 may provide a seal-like closure of the opening 708, and as such tightly close the lid 700. Thus, by rotating the inner layer 701 and aligning the insulated area 704 with the opening 708, the consumer can easily close the can to protect its content for future use.

The protrusions 716 and 714 are designed such that they are comparable in size and thus fit inside the small openings 710 and 715. In this manner, the protrusion 716 can be connected to the tab 713 such that the inner layer 701 can be rotated around the central point 702 by moving the tab in the horizontal direction. The central point 702 may be connected to the protrusion 716 to enable this rotation. By moving the inner layer 701, a consumer can change the mode of the lid 700 from direct consumption to use of a straw through the opening 703 (when opening 703 is aligned with the opening 706) to closing the lid by aligning the insulated area 704 with the opening 706, as desired.

In one implementation, the tab 713 may also be lifted and moved in the vertical direction to apply pressure via the protrusion 714 to the insulated area 704. By applying pressure, the insulated area 704 may be pushed down, such that the opening 706 can be opened to provide access to the contents of the can.

Figure 10A:
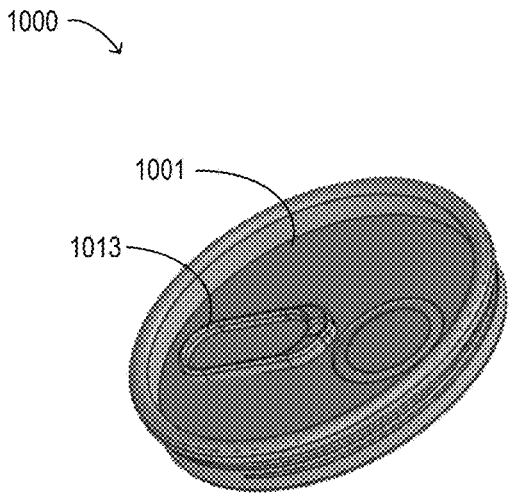
FIGS. 10A-10B are front and back views, respectively, of an alternative multi-positional lid.
Figure 10B:
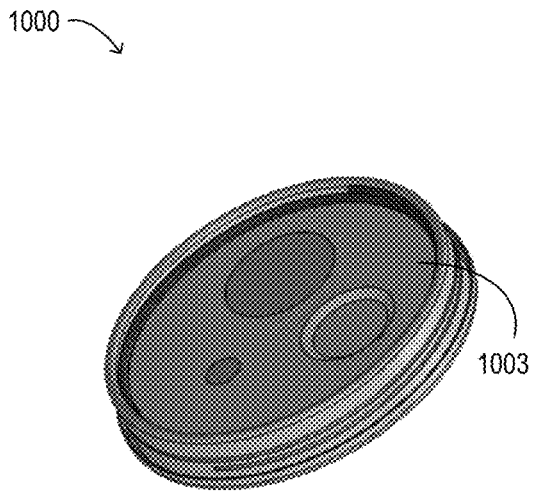

FIGS. 10A-10B depict front and back views, respectively, of an alternative multi-positional lid 1000. The multi-positional lid 1000 includes an outer layer 1001, an inner layer 1003 and a tab 1013, positioned on the top surface of the outer layer 1001. In this implementation, the inner layer 1003 can be movable, while the other layer 1001 is stationary.

Figure 11:
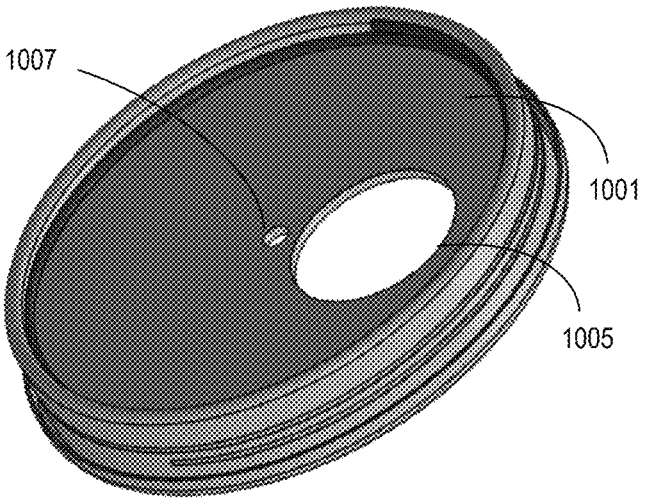
FIG. 11 is a back view of an outer layer of the multi-positional lid of FIGS. 10A-10B.

FIG. 11 depicts a back view of one implementation of the outer layer 1001. The outer layer includes a large opening 1005 through which the beverage can flow out either directly or through the use of a straw. The outer layer 1001 also includes a small opening 1007 to enable insertion of a protrusion of the inner layer. In this manner, the small opening 1007 may connect the inner layer 1003 to the tab 1013, as discussed further below.

Figure 12A:
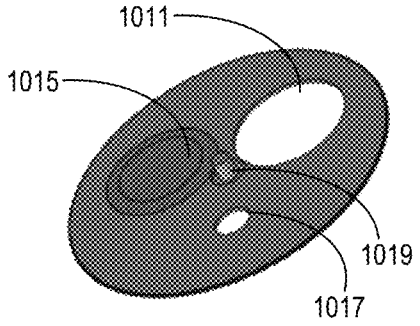
FIGS. 12A-12B are front and back views, respectively, of an inner layer of the multi-positional lid FIGS. 10A-10B.
Figure 12B:
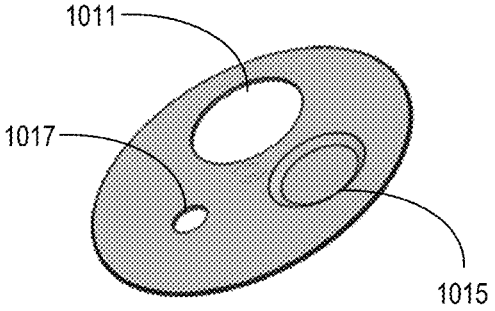

FIGS. 12A-12B depict front and back views of the inner layer 1003 of the multi-positional lid 1000. The inner layer 1003 includes a large opening 1011, an insulated area 1015, a small opening 1017 and a protrusion 1019. The small opening 1017 provides a space through which a straw can be inserted into the can o enable comfortable consumption of the beverage with a straw. The large circular opening 1011, on the other hand, can be used for direct consumption of the beverage from the can, as the larger opening allows for easier flowing out of the liquid from the can. The insulated area 1015 includes a circular area covered with an insulated material for sealing the opening 1005 of the outer layer. As shown in FIG. 12A, the top surface of the inner layer 1003 also includes a protrusion 1019 for creating a central point around which the inner layer (or outer layer) can rotate.

The multi-positional lid 1000 may also include a sealing layer and a handle for removing the sealing layer, similar to the sealing layer 11 and handle 12 of FIG. 3 or the sealing layer 705 and handle 712 of FIG. 7C. The sealing layer may be utilized to ensure safety and sanitation for the contents of the can.

Figure 13A:
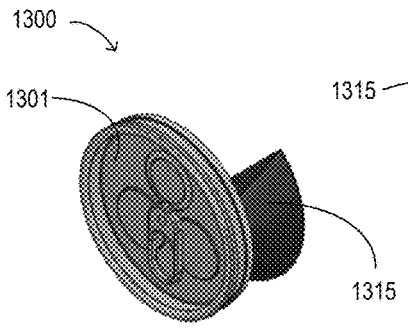
FIG. 13A is a front view of a multi-positional lid having a semi-circular funnel.
Figure 13B:
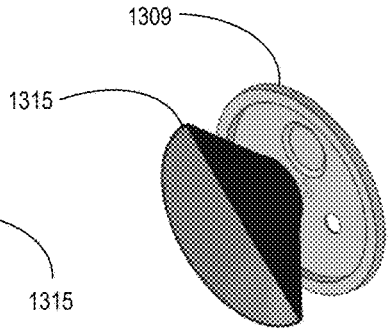
FIGS. 13B-13C are back and front views, respectively, of an inner layer of the multi-positional lid of FIG. 13A.
Figure 13C:
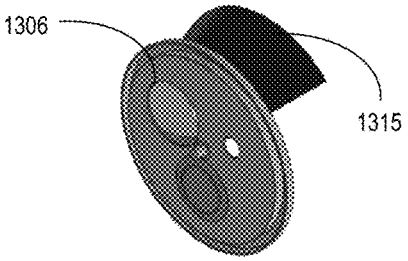

In one implementation, either the inner layer of the multi-positional lid may include a cone-shaped insertion for enabling easy consumption and/or pouring of the beverage. One implementation of such a design is illustrated in FIGS. 13A-13C. The multi-positional lid 1300 of FIG. 13A includes an outer layer 1301 and a semi-circular funnel 1315 attached to an inner layer 1309. The semi-circular funnel 1315 may be attached to the bottom surface of the inner layer 1309 around the edges of a large opening 1306. In this manner, any liquid entering the large opening 1306 would enter and flow through the funnel 1315, thus controlling the flow of the liquid and providing a more pleasant experience for the consumer. Moreover, the funnel 1301 prevents the need to fully tilt the can, as the volume of the beverage decreases and helps avoid the common issue of not being able to drink the entire contents of the can because of the difficultly associated with getting all the liquid out and into a person's mouth.

Figure 14A:
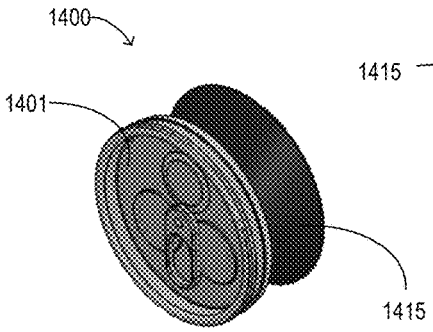
FIG. 14A is a front view of a multi-positional lid having a fully-circular funnel.
Figure 14B:
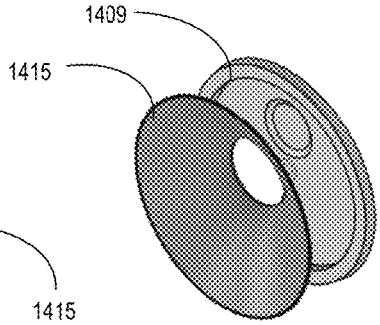
FIGS. 14B-14C are back and front views, respectively, of an inner layer of the multi-positional lid of FIG. 14A.
Figure 14C:
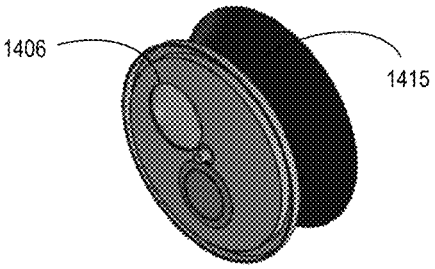

An alternative implementation is depicted in FIGS. 14A-14C in which the multi-positional lid 1400 includes a full-circular funnel 1415 attached to an inner layer 1409. As with the multi-positional lid 1300, the multi-positional lid 1400 includes an outer layer 1401 connected to the inner layer 1409. The full-circular funnel 1415 is attached to the bottom surface of the inner layer 1409 around the edge of the large opening 1406, such that all liquid flowing from the can to the large opening passes through the full-circular funnel 1415. It should be noted that the semi-circular funnel or full-circular funnel can be incorporated with any of the multi-positional lids discussed herein.

Accordingly, the multi-positional lid for a can provides a versatile, easy to use lid that includes a tamper resistant sealing cover for ensuring safety and preventing tampering with the product, but can also be closed after initial use, thus keeping the contents sanitary for future consumption and preventing decarbonation. The multi-positional lid provides different modes for directly drinking from the can and using a straw. Moreover, the multi-positional lid is easy to open and operate, thus avoiding some of the disadvantages of currently used can lids. Thus, this description is related to a multi-positional lid which is open and closable multiple times via either postural movement (e.g., FIG. 3), pressure exerted on the lid (FIG. 7), or rotational movement (e.g., FIGS. 6 and 10) or a combination of these techniques and provides multiple modes such as drinking with a straw, drinking directly from the can, or closed. It should be noted that each one of the implementations discussed herein can be incorporated with features discussed with respect to FIGS. 13A-13C and 14A-14C.

The various layers and parts discussed herein may be made from materials such as metal, for example, alloys of aluminum or aluminum, or non-metallic materials which include plastics, compounds or derivatives of plastics, polyvinyl chloride (PVC), any combinations of these materials, paper of various types or similar materials, or any other material that can be used.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

What is claimed is:

1. A multi-positional lid for a beverage can comprising:

an outer layer immovably attached to a wall of the beverage can, the outer layer including a first large opening and a first small opening; and an inner layer movably connected to the outer layer, the inner layer including a second large opening, a second small opening, and a protrusion and an insulated area positioned in a top surface of the inner layer;

wherein the protrusion fits inside the first small opening to movably connect the inner layer to the outer layer, and the inner layer is rotatable around the protrusion to change a mode of the multi-positional lid by aligning one of the second large opening, the second small opening or the insulated area with the first large opening of the outer layer.

2. The multi-positional lid of claim 1, wherein the second small opening is configured for use with a straw.

3. The multi-positional lid of claim 1, wherein the second large opening is the same size as the first large opening.

4. The multi-positional lid of claim 1, wherein aligning the second large opening with the first large opening enables a user to consume a beverage directly from the beverage can.

5. The multi-positional lid of claim 1, wherein the insulated area fits in the first large opening once aligned with the first large opening to close the multi-positional lid.

6. The multi-positional lid of claim 1, wherein the outer layer includes two housing units for housing the insulated area as the inner layer rotates.

7. The multi-positional lid of claim 1, further comprising a removable sealing layer covering the outer layer and a handle attached to the removable sealing layer for removing the sealing layer.

8. The multi-positional lid of claim 1, further comprising a funnel attached around an edge of the second large opening to guide a flow of the beverage.

9. A multi-positional lid for a beverage can comprising:

a rotatable outer layer including a first large opening, a small opening, and an insulated area and an indentation on a bottom surface of the rotatable outer layer; and an inner layer permanently attached to a wall of the can, the inner layer including a second large opening, and a protrusion;

wherein the protrusion fits inside the indentation to connect the rotatable outer layer to the inner layer, and the rotatable outer layer is rotatable around the protrusion to change a mode of the multi-positional lid by aligning one of the first large opening, the first small opening or the insulated area with the second large opening of the inner layer.

10. The multi-positional lid of claim 9, wherein aligning the insulated area with the second large opening closes the multi-positional lid.

11. The multi-positional lid of claim 9, wherein aligning the small opening with the second large opening enables use of straw with the can.

12. The multi-positional lid of claim 9, wherein the second large opening is the same size as the first large opening and aligning the second large opening with the first large opening enables a user to consume the beverage directly from the can.

13. The multi-positional lid of claim 9, further comprising a removable sealing layer covering the outer layer and a handle attached to the sealing layer for removing the sealing layer.

14. The multi-positional lid of claim 9, further comprising a funnel attached around the edges of the second large opening to guide the flow of the beverage.

15. A multi-positional lid for a beverage can comprising:

an outer layer permanently attached to a wall of the can, the outer layer including a first large opening, a first small opening, and a second small opening;

a rotatable inner layer including a third small opening, and a first protrusion, a second protrusion, and an insulated area on a top surface of the rotatable inner layer; and a tab positioned on top of the outer layer and movably connected to the outer layer and the rotatable inner layer, the tab having an indentation on a bottom surface;

wherein:

the first protrusion fits inside the first small opening, the second protrusion passes through the second opening and fits inside the indentation; and the rotatable inner layer is rotatable around the second protrusion to change a mode of the multi-positional lid by aligning the first large opening with the third small opening or the insulated area, or leaving the first large opening unobstructed.

16. The multi-positional lid of claim 15, wherein the rotatable inner layer is rotatable by moving the tab in the horizontal direction.

17. The multi-positional lid of claim 15, wherein aligning the first large opening with the insulated area closes the lid.

18. The multi-positional lid of claim 17, wherein the lid can be opened by lifting the tab.

19. The multi-positional lid of claim 15, further comprising a removable sealing layer covering the first large opening and a handle attached to the sealing layer for removing the sealing layer.

20. The multi-positional lid of claim 15, wherein the third small opening is configured for insertion of a straw.

* * * * *